United States Patent [19]

Grosser et al.

[11] 4,272,073

[45] Jun. 9, 1981

[54] ALUMINUM BALANCE BEAM

[75] Inventors: Richard W. Grosser, Boone; Virgil L. Long, Sr., Jefferson, both of Iowa

[73] Assignee: AMF Incorporated, White Plains, N.Y.

[21] Appl. No.: 956,830

[22] Filed: Nov. 2, 1978

[51] Int. Cl.[3] ..... A63B 7/08

[52] U.S. Cl. ..... 272/111; 52/731; 272/112

[58] Field of Search ..... 52/730, 731; 272/62, 272/63, 111, 112, 113; 256/59, 65; 40/155; D25/77, 78

[56] References Cited

U.S. PATENT DOCUMENTS

| | | | |
|---|---|---|---|
| 3,582,068 | 6/1971 | Hallgren | 272/111 |
| 3,945,167 | 3/1976 | Wendt | 52/731 |

FOREIGN PATENT DOCUMENTS

| | | | |
|---|---|---|---|
| 2318208 | 10/1974 | Fed. Rep. of Germany | 272/111 |
| 2231275 | 12/1974 | France | 52/731 |
| 2354426 | 6/1978 | France | 52/730 |
| 996810 | 6/1965 | United Kingdom | 272/111 |

OTHER PUBLICATIONS

Sweets Catalog "Railings" Blumcraft of Pittsburgh, p. 38, 1971.

Sweets Catalog "Panel Rail" Blumcraft of Pittsburgh, p. 19, 1976.

*Primary Examiner*—Robert W. Michell

*Assistant Examiner*—J. L. Kruter

*Attorney, Agent, or Firm*—George W. Price; Walter Lewis

[57] ABSTRACT

The invention relates to a gymnastic balance beam of extruded aluminum with a bottom and end closures. The beam is of a general U-shape with the bottom plates secured to a flanged portion of the beam. The beam can be selectively covered with padding if desired.

3 Claims, 5 Drawing Figures

ALUMINUM BALANCE BEAM

This invention relates to an aluminum balance beam, and more particularly, to a padded aluminum gymnastic balance beam.

Heretofore it has been common to make gymnastic balance beams from wood, and also to have wooden balance beams that are covered with padding and an outer skin such as natural or synthetic leather. Besides being strong, the wood beams must have an exact predetermined geometry and provide a long life even though subjected to rigorous use and under varying ambient conditions. To meet all these requirements with wood is an expensive proposition. The woods have to be specially selected and then fabricated to exact shape, the latter requiring many time consuming manufacturing steps; and, having done that, the beams must be relatively unaffected by temperature and/or humidity conditions.

In our invention we overcome the disadvantages of the prior art by making the balance beam from extruded aluminum. This reduces costs because the aluminum beams can be readily formed to shape, and are not subject to the deleterious effects of variations in temperature and/or humidity such as warping and cracking. Also, the aluminum beams are stronger than comparable wood beams. Thus, besides being easier to manufacture and lower in cost, aluminum balance beams are a better product.

The invention and further advantages thereof will be best understood by considering the following detailed description of one form thereof taken in connection with the accompanying two sheets of patent drawings in which FIG. 1 is a broken away and exploded perspective view thereof;

Figure 1:
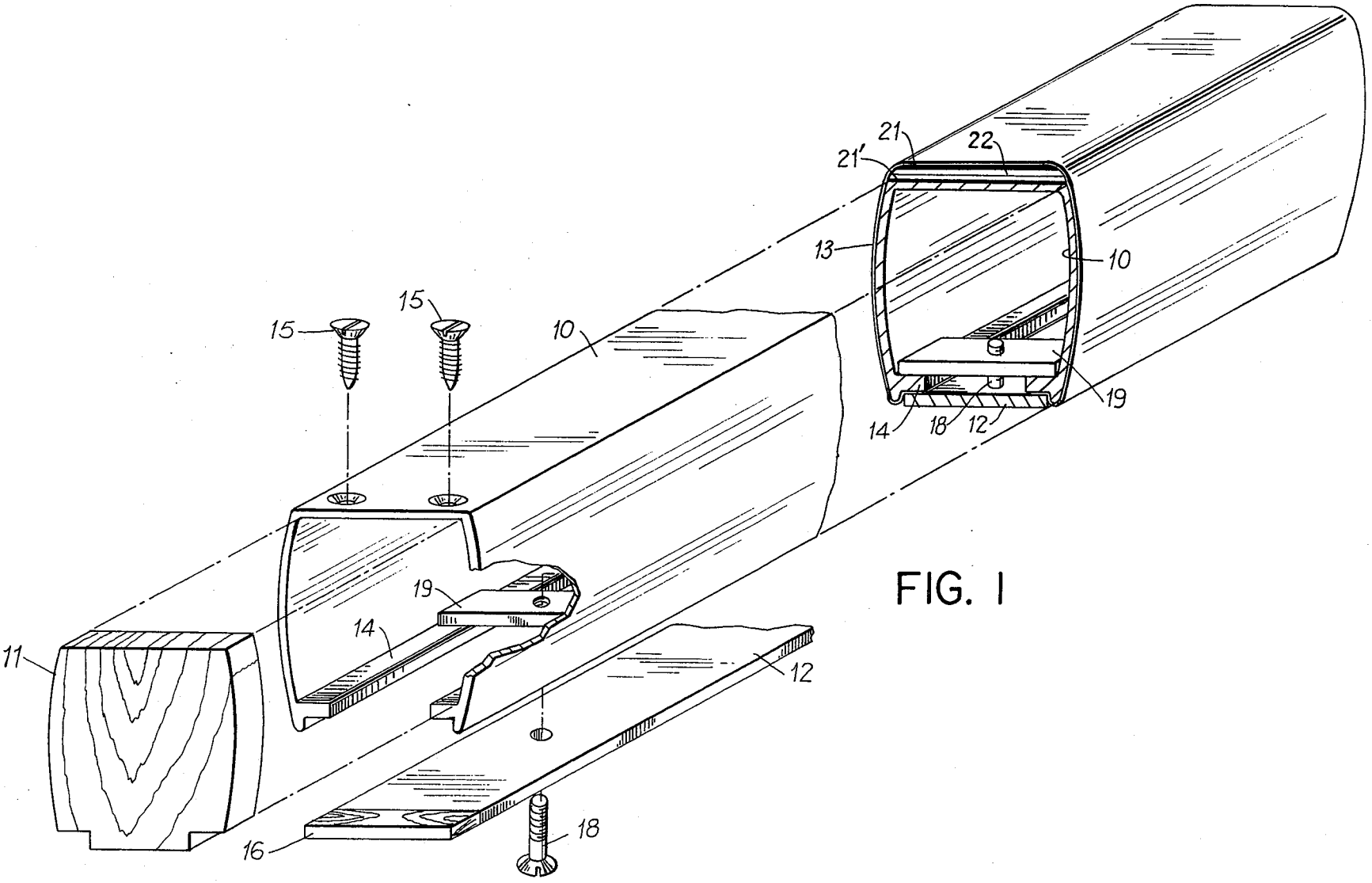
Figure 2:
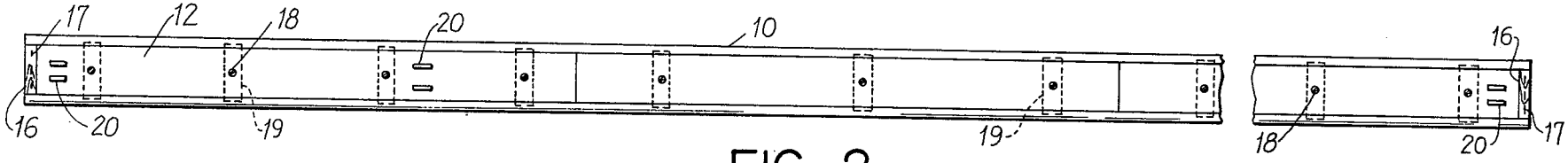
FIG. 2 is a broken away bottom plan view.

Referring now to the drawings, the improved aluminum gymnastic balance beam of the invention comprises a minimum number of parts. The basic building member is a hollow extruded elongated aluminum member 10. It is in the form of an elongated box open at its bottom and opposite ends. At its ends it is closed by a pair of end caps 11, and at its bottom it is closed by a series of elongated bottom plates 12. The beam may have an outer natural leather or synthetic leather-like skin or cover 13, and padding can be provided beneath the outer cover 13.

Figure 5:
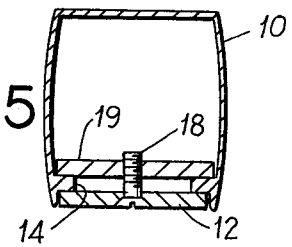
FIG. 5 is a cross-sectional view taken along the section line 5—5 of FIG. 3.
Figure 4:
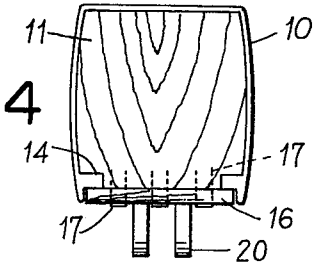
FIG. 4 is an end view from along the end view line 4—4 of FIG. 3.

As is best seen from FIGS. 1, 4 and 5, the aluminum member 10 is C or U-shaped in cross-section with the open side of the C or U facing down. Two opposite inside flanges 14 are formed on member 10 just above the open bottom side edges thereof. The caps 11, which may comprise wood, are shaped complementary to the beam end openings, and are held therein by means such as screws 15. The end assembly is finished by a pair of wood strips 16 that bridge the flanges 14 and are connected to the caps 11 by means such as staples 17, see FIG. 4.

The several plates 12, which may be steel, also span the outside of the flanges 14 and extend from one end strip 16 to the other. The material for the plates 16 should be selected for strong strength, since after they are affixed to the beam they reinforce the beam in terms of strength and weight and, in addition, serve as means for fastening not shown support struts for the beam to support the same in elevated position on a gym floor. The plates 12 are affixed to beam 10 by threaded studs 18 which go through suitable holes in plates 12 into threaded holes in cross clamp pieces 19. The cross clamp pieces 19 span the flanges 14 on the inside and the plates 12 span the flanges 14 on the outside. Thus, when the studs 18 are drawn up tight, the plates 12 are clamped to the beam 10 along the bottom thereof. Two pairs of spaced lugs 20 can be formed on the two endmost plates 12 for the purpose of connecting not shown support struts thereto in a manner well-known to those skilled in the art.

Figure 3:
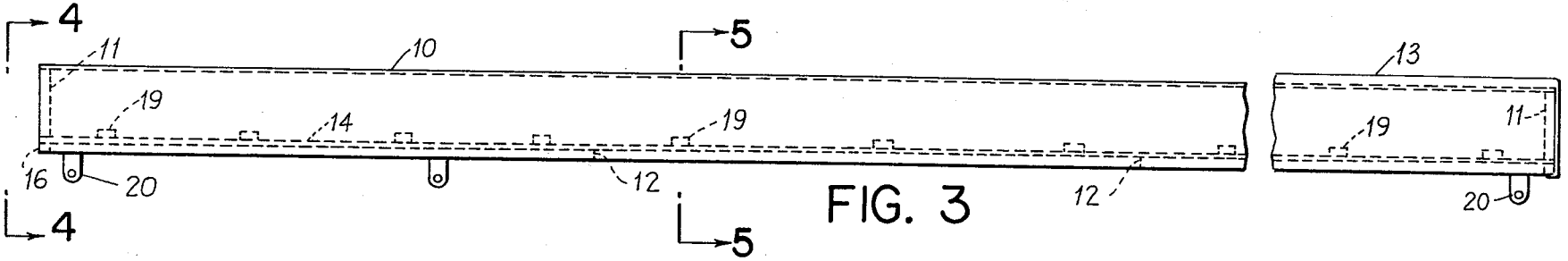
FIG. 3 is a broken away side elevation view.

As best seen in FIG. 1, the outer skin extends around the beam and at its bottom edges is clamped between the flanges 14 and plates 12. It can be padded on its top beneath the skin 13. The padding can comprise upper and lower layers of plastic foam 21, 21' and an intermediate plywood spacer 22. At its ends the cover 13 can be folded over the caps 11, such as shown at the right-hand end of FIG. 3, and stapled at the bottom to strip 16.

It will now be seen that the invention provides a superior product which is also low cost. It uses a minimum of parts which are easy to obtain and fabricate. For example, the beam 10 can be readily shaped to the desired final form and with a very high degree of certainty by conventional extrusion procedures merely by selecting the proper extrusion dies or the like. The plates 12 and cross pieces 19 are rather conventional parts and are readily assembled to the beam 10 by virtue of its flanges 14. In addition, these parts 12, 14, 19 besides reinforcing the beam 10 and serving as the means for connecting not shown support struts thereto, also serve as the means for neatly holding the outer cover 13 in place in snug conformity with the beam 10 along its entire length. The arrangement of these parts also facilitates repair work on the beam. For example, should a new cover 13 be desired, in order to remove and replace the same, it is only necessary to loosen the plates 12, put in a new one, and then retighten the plates. The plates 12, of course, can be readily adapted to receive different types of support struts simply by connecting the desired type of fixtures thereto.

We claim:

1. An aluminum gymnastic balance beam comprising an elongated extruded aluminum box-shaped member which is open at its bottom and opposite ends, said box-shaped member being thin walled relative its exterior dimensions, closure means for said ends, closure means for said bottom, said last-mentioned closure means being anchored to said beam and having means thereon which is adapted to have support struts connected thereto, said member having a general U-shape in cross-section, the open side of said U-shape facing down, a pair of spaced opposite flanges formed inside said member adjacent the bottom of the open side of said U-shape, said bottom closure means comprising a series of elongated plates extending along said beam at its bottom, and means clamping said plates to said flanges with said flanges being positioned between said clamping means and plates.

2. In a beam, as in claim 1, said clamping means comprising cross pieces inside said box over spanning the inside of said flanges, said plates over spanning the outside of said flanges, and means extending through said plates and cross pieces to clamp said flanges therebetween.

3. In a beam, as in claim 2, an outer cover on said beam, said cover extending along the top of said beam and about the sides thereof to between said plates and flanges for clamping therebetween by said clamping means, and pad means on said beam between the top thereof and said cover.

* * * * *